United States Patent [19]

Black et al.

[11] 3,973,492

[45] Aug. 10, 1976

[54] WEB SLIT REGISTRY

[75] Inventors: James A. Black, Kent City; Harry Russell Farwell, Cedar Springs, both of Mich.

[73] Assignee: James A. Black, Kent City, Mich.

[22] Filed: Oct. 31, 1974

[21] Appl. No.: 519,591

[52] U.S. Cl. ..... 101/126; 83/278; 101/115; 101/124; 101/181; 101/228; 226/52; 226/88

[51] Int. Cl.[2] ..... B41F 15/24; B65H 23/00

[58] Field of Search ..... 101/115, 116, 118, 126, 101/129, 228, 181; 226/2, 6, 24, 16, 33, 52, 55, 62, 88; 83/278

[56] References Cited

UNITED STATES PATENTS

| | | | |
|---|---|---|---|
| 979,406 | 12/1910 | Armstrong | 83/278 X |
| 2,052,638 | 9/1936 | Marquardt | 101/228 |
| 2,169,058 | 8/1939 | Price | 226/52 |
| 2,612,835 | 10/1952 | Marek et al. | 101/126 |
| 2,725,101 | 11/1955 | Von Hofe | 83/278 X |
| 3,174,371 | 3/1965 | Macomber | 83/86 |
| 3,605,614 | 9/1971 | Gilman et al. | 101/126 |
| 3,848,528 | 11/1974 | Seedorf | 101/126 X |
| 3,874,621 | 4/1975 | Blair | 226/88 X |
| 3,880,076 | 4/1975 | Black et al. | 101/115 |

*Primary Examiner*—Edgar S. Burr
*Assistant Examiner*—R. E. Suter
*Attorney, Agent, or Firm*—Price, Heneveld, Huizenga & Cooper

[57] ABSTRACT

Slit registry apparatus and method for registry of flexible, generally planar stock as for stencilling thereon, involving formation of periodic transverse slits and adjacent edges in the stock, at least one of the edges and the adjacent stock zone or area being offset from the plane of the stock for engagement of this offset edge by a registration surface.

8 Claims, 14 Drawing Figures

WEB SLIT REGISTRY

BACKGROUND OF THE INVENTION

This invention relates to registration of stock such as sheet or web stock, for accurately performing an operation such as stencilling thereon. The invention was developed chiefly for the field of stencilling and will therefore be explained largely in that background, although having other potential applications.

The well known art of screen stencilling is widely employed for depositing coating materials for various decorative and for functional purposes. Such coating materials include substances such as inks, adhesives, and/or a variety of other functional and/or decorative substances. They are applied to web or sheet substrate stock of paper, polymeric materials, wood or cloth and laminates of various materials. The resulting products include posters, prints, decalcomania, graphic designs and others too numerous to list.

To accurately deposit the coating substance, position registry of the substrate stock must be accurate. Although the degree of accuracy required will vary depending upon the operation and the product involved, the stencil printing of multiple color inks requires a high degree of registration accuracy during the successive printing steps of individual colors. Unfortunately, such accuracy is not always obtainable using known techniques. For example, a common registration technique for web stock involves a punched hole through which a correspondingly shaped pin is projected at each printing station. The edges of the hole often become progressively more and more distorted at each station into an elongated configuration, preventing accurate registration. Also, the holes render areas of the stock otherwise useless and unsightly. Further, the stock must be penetrated for each registry by an inserted pin, so that the rate of stock movement is limited to allow this insertion and withdrawal.

The application of special registration tabs as set forth in U.S. Pat. No. 3,783,059 is often advantageous. But tabbing of the stock is not always possible or desirable either.

As to sheet stock, attempts to use the leading stock edge for registration are often not practical, particularly for accurate registry, since this edge is the one placed in the clamps as on the impression cylinder of a press. The registration equipment for this is disadvantageously within the range of the stencil screen and squeegee. Hence, the leading edge of the sheet is thus in a crowded area, affording only limited clearance. And, when lightweight or soft sheet stock is encountered, the conventional cylinder guides that must push the sheet back by engaging the front edge of register it, frequently cannot effectively push such stock without at least wrinkling the sheet, rendering the registration unreliable.

SUMMARY OF THE INVENTION

The present invention employs unique slit registry of sheet or web stock, the stock being transversely slit, and then the edge of the stock at the slit, and the stock area adjacent the slit being offset out of the plane of the stock to expose the edge which is then engaged by a registration surface. The stock can be shifted by this engagement to a predetermined position, placing the stock in registration with a stencilling station or the like. An important object of this invention, therefore, is to provide unique slit registry for stock to be stencilled or the like. The slit registry enables a substantial edge dimension to be engaged without the distortion common to hole and pin registry systems. The system is simple in practice, enabling effective, accurate registry without complicated apparatus. Registry components on a stencil press can be positioned out of range of the stencil and squeegee, to function on the tail portion of sheet stock. Lightweight sheets can be registered by pulling on this tail portion, without crumpling the leading edge during attempted push back as previously done. Multiple slits can be employed to increase the contact area.

Another object of this invention is to provide slit registry of web stock being stencilled, by registry of a wet web portion just previously stencilled for accurate positioning of the following web portion about to be stencilled.

These and several other objects, advantages, and features will be readily apparent from a study of the following detailed description and the drawings setting forth illustrative embodiments of the invention.

DESCRIPTION OF THE PREFERRED EMBODIMENTS

First Embodiment

Figure 4:
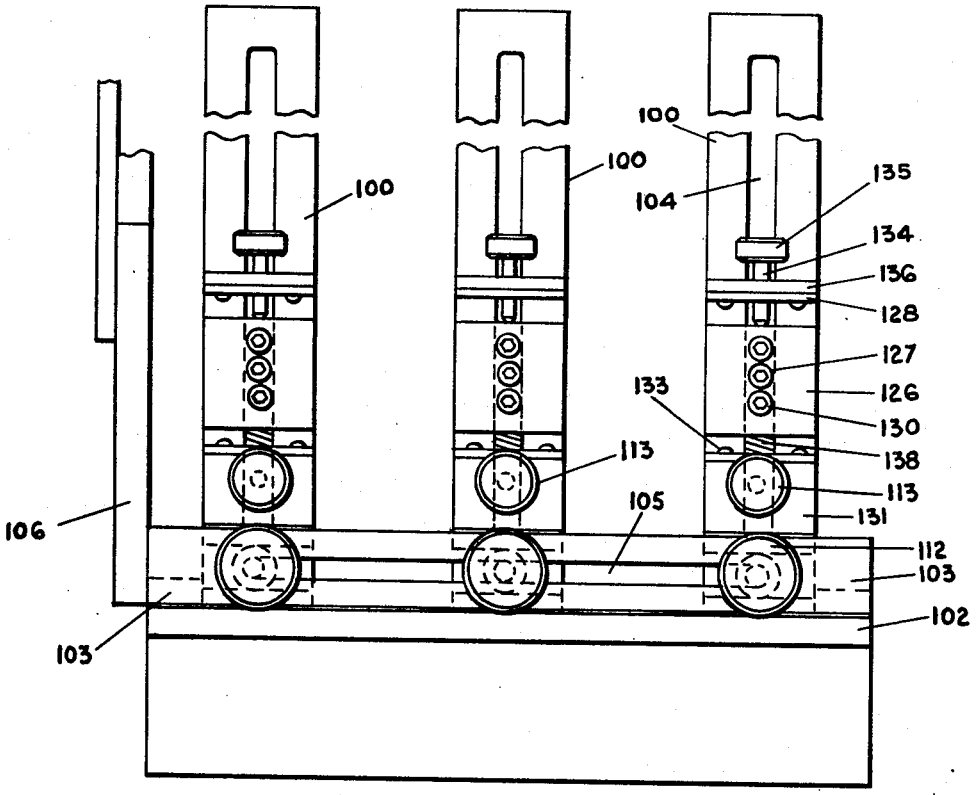
FIG. 4 is a partial elevational view of the slit registry apparatus in FIG. 3, taken at IV—IV from the left side of the structure as viewed in FIG. 3.

Referring now specifically to FIGS. 1–5, the first preferred embodiment slit registry apparatus is there depicted in combination with web stencilling equipment. The total assembly 10 is shown to include (FIG. 5) stencilling apparatus 12 for generally continuous web stock W, vacuum registry subassembly 14 downstream of apparatus 12, slit forming subassembly 16 upstream of apparatus 12, and web tension control means 18 upstream of apparatus 12 and slit forming subassembly 16.

Figure 1:
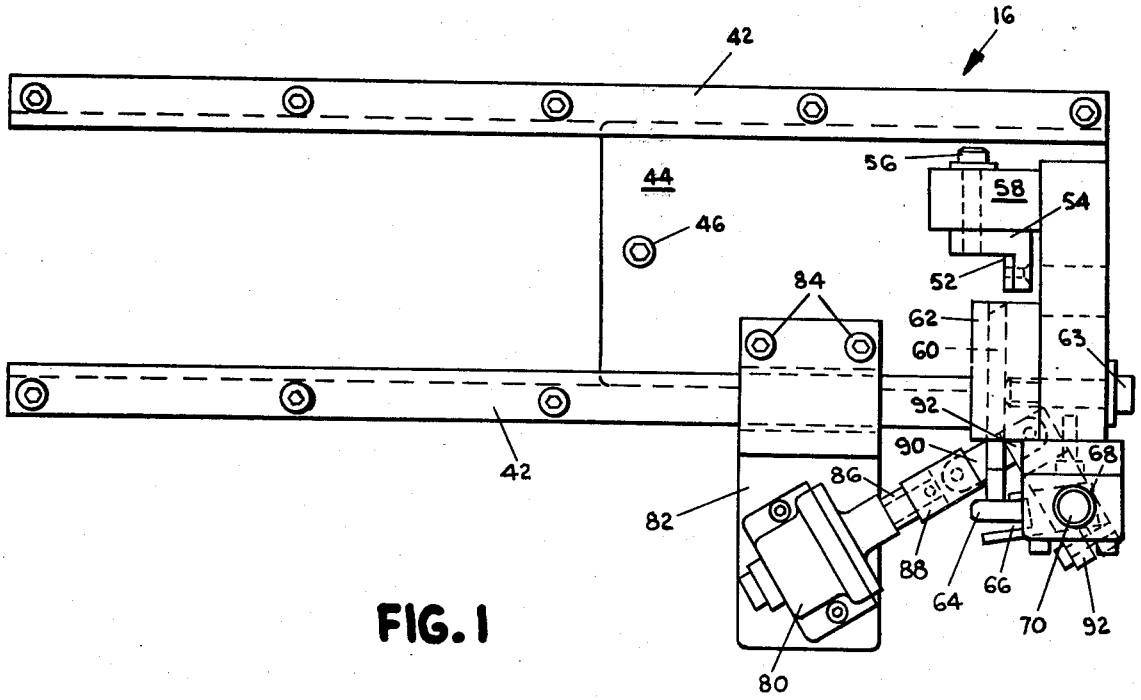
FIG. 1 is an elevational view of slit forming apparatus for the invention.
Figure 2:
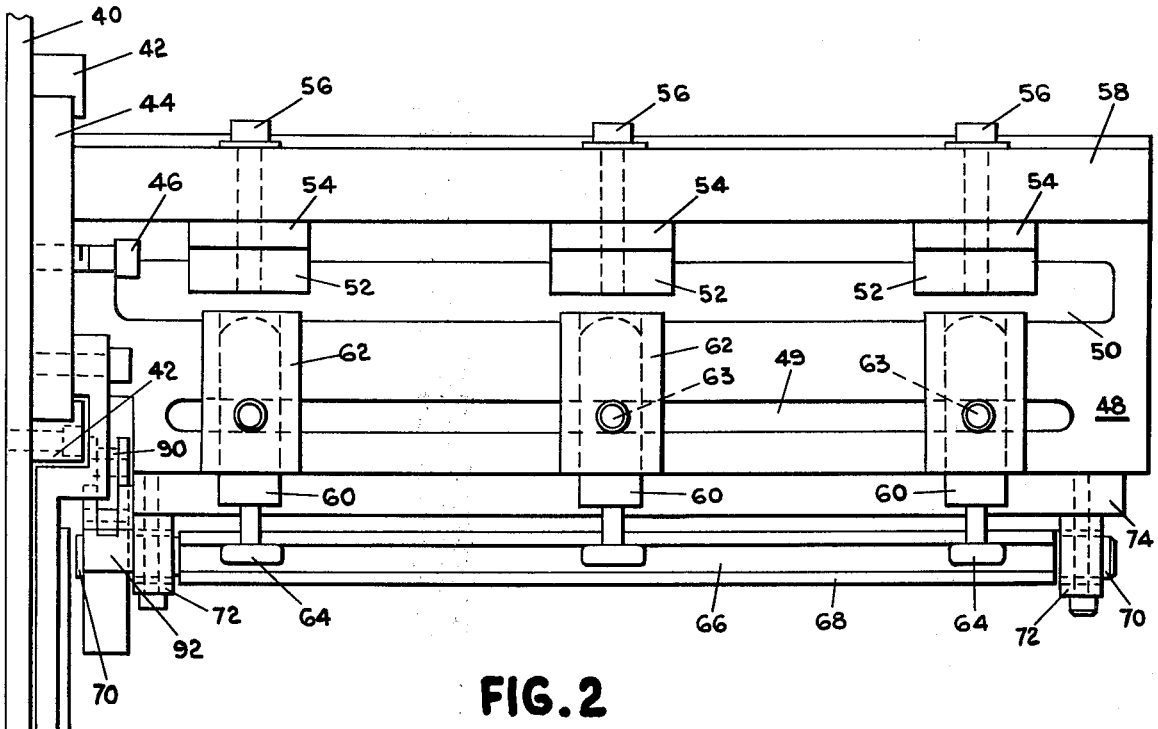
FIG. 2 is a plan view of the slit forming apparatus in FIG. 1.

Slit forming subassembly 16 is shown in more detail in FIGS. 1 and 2. Registry subassembly 14 is shown in more detail in FIGS. 3 and 4, and is discussed in detail hereinafter. Web tension control subassembly 18 may comprise a typical vacuum bar or plate including a housing 20 having vacuum orifices 22 opening toward the web stock and communicating through internal passages to a suitable vacuum supply (not shown) such as a vacuum pump or reservoir through suitable conduits 24. Orifices 22 may be several in number, spaced from each other in a direction transversely of the direction of web travel. This vacuum plate or bar has a web engaging surface 21 containing vacuum orifices 22. The bar is shiftable rearwardly of the direction of web travel by suitable power means such as a fluid cylinder 26 or the like for imparting a reverse pull on web W for reasons to be explained in detail hereinafter.

Stencilling apparatus 12 includes a stock support member 30 which is preferably a rotating cylinder, (but alternately could be a flat bed) cooperative with squeegee coating means including stencil screen frame 32 for mounting the stencil in the lower surface thereof, and squeegee 34. This apparatus 12 may for example take the form illustrated and discussed in detail relative to FIG. 8*a* in U.S. Pat. No. 3,783,059, such being incorporated by reference herein. With such an apparatus, a stencil screen of predetermined pattern is mounted on the lower planar portion of stencil screen frame 32, with ink or other stencilling fluid being placed within the frame on the surface of the screen such that, relative movement between the lower edge of squeegee 34 and the screen causes a portion of the fluid to be forced through the openings in the screen onto the underlying substrate surface supported on and advanced with cylinder 30. This occurs with advancement of the surface of web W simultaneously with rotation of drum 30 and movement of stencil screen frame 32 in the direction of rotation of the drum, while the squeegee 34 remains basically stationary above the crown of the drum. The stencil screen frame and squeegee can also be moved vertically relative to the cylinder to move them into and out of engagement with the stock and cylinder. Just prior to the print stroke, it is important that the web be properly registered, i.e. that the exact portion of the web to be printed be correlated with the stencil screen frame. This is particularly significant in some applications, such as the application of multiple coatings of various colors in accurate correlation with each other.

To achieve this registration, employing this invention, slit registry is used. The slits are cut into the web W, each oriented transversely relative to the stock direction of advancement. In FIGS. 1 and 2, apparatus is shown for forming up to three slits in the stock. This slitter subassembly 16 includes a mounting plate 40 which preferably also constitutes the printing cylinder lift plate, and to which a pair of cooperative slide elements 42 are attached to form a slide track receiving a slide plate 44. Movement of this slide plate longitudinally of the apparatus, i.e. in the direction of the stock advancement, allows adjustment control of the slitter. Locking bolt 46 threadedly extending through slide plate 44 abuts mounting plate 40 to lock the slide plate in any selected position along the extent of tracks 42. Projecting laterally from slide plate 44 is a transversely oriented support beam 48 having one end mounted to slide plate 44 to move therewith. Extending through this support beam 48 is an elongated slot 50 through which the stock passes. Adjacent the upper edge of slot 50 is a plurality, here three, of hardened steel cutting edges 52, each mounted to an L-shaped bracket 54, in turn secured by elongated bolts 56 to a slotted bar 58 extending the length of beam 48. This bar 58 has an elongated slot extending most of its length, enabling the position of cutting edges 52 to be varied by loosening bolts 56 and adjusting their position along with adjustment of the position of members 58, 54 and 52 along the length of bar 58. Cooperative with respective ones of these cutting elements 52 is a plurality of shiftable slitting blades 60 movable toward and away from cutting edges 52 across the breadth of slot 50 through which the stock travels. Each shiftable blade 60 is guided by a guideblock 62 through which element 60 extends vertically. Mounted to the lower end of each of the cutting elements 60 is a collar 64. This collar or head projects radially into the elongated slot 66 between flanges of an elongated pivot bar 68 pivotally attached on its opposite ends by pins 70 to a pair of spaced bearing blocks 72. These bearing blocks are attached to and depend from a base bar 74, in turn secured to the bottom edge of beam 48. Pivoting of this pivot bar thus causes slitting blades 60 to move upwardly across the space 50 through which the stock travels, into cooperative relationship with the cutting edges 52, to form transverse slits through the stock. These cutting elements can be transversely adjusted by reason of each guide 62 being mounted by a stud 63 to beam 48 through an elongated adjustment slot 49. Thus, by loosening bolts 63, these elements may be slid along slot 49 to the desired position in cooperative relationship with the likewise adjusted elements 52. Shifting of pivot bar 68 is achieved by a suitable motor means such as the fluid cylinder 80. This cylinder is mounted to a suspension bracket 82 which in turn is secured to the slide plate 44 as by bolts 84. Secured to the internal piston (not shown) of this cylinder, is the extended rod 86 to which a connector 88 is attached. A link 90 is pivotally connected on one of its ends to this connector 88, and pivotally connected on another one of its ends to a crank 92. This crank is attached to one of the pivot pins 70 of pivot bar 68 such that, extension of the fluid cylinder causes the crank and pivot bar to be rotated clockwise as the structure is viewed in FIG. 1 to raise cutting blades 60. Retraction of the cylinder reverses this movement to lower the blades.

Using this apparatus, one or more slits may be formed in the web or other stock as it is positioned in slot 50. Also, if narrow web stock is being printed, a plurality of such webs, e.g. three, may be fed through the elongated slot side by side such that, each slitter operates upon a respective web to form spaced registration slits along the length thereof. Or, the center slitter or two slitters may be removed so that only one slitter is operative upon one edge of the stock. Or alternatively, if putting registration slits in sheet stock, two of the slitters may be employed to form a pair of registration slits at the tail end portion of the sheet stock. Other variations are also possible.

Figure 3:
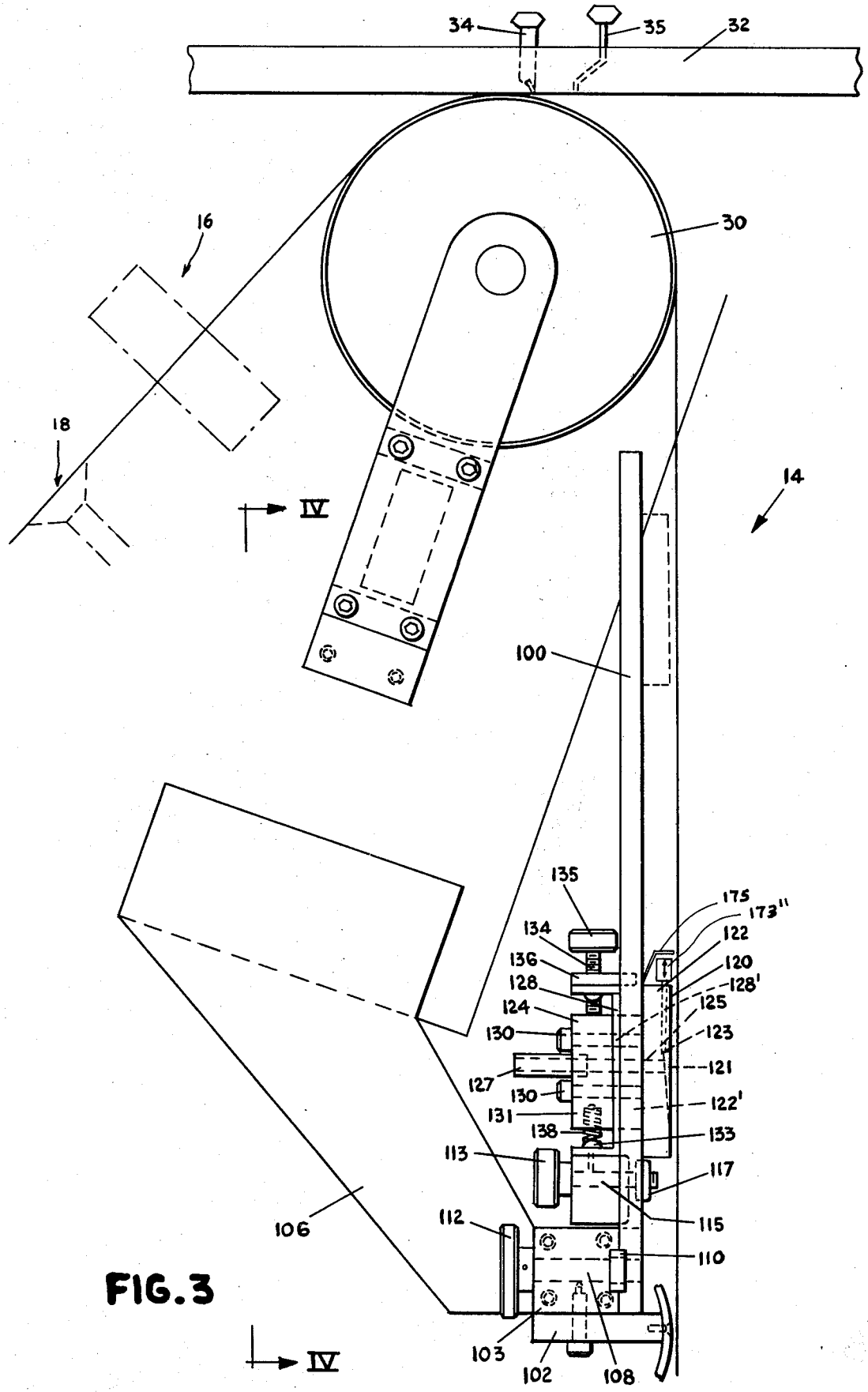
FIG. 3 is an elevational view of the first embodiment of slit registry apparatus in combination with web stencilling apparatus.

The first embodiment of the registration apparatus 14 is shown in detail in FIGS. 3 and 4, for registration of the stock by the use of the transverse slits and adjacent stock areas. This registration apparatus is downstream of print cylinder 30 and the other components at the print station including stencil screen frame 32, squeegee 34, and flow coater 35. This particular registration apparatus depicted has three units, side by side, to cooperate with three web zones which can all be in one web or can be in three separate webs. As will be understood, only one of these units need be used in some situations, two in others, three in still others, and so forth. These three like registration devices are mounted on three like, vertically oriented supports 100, the lower end of these supports being secured to an elongated mounting bar 102 and an elongated block 103, one end of the block in turn being secured to a bracket 106. Block 103 has an elongated horizontal slot 105 therethrough for transverse adjustment of the registration units relative to each other, and transversely to the direction of stock advancement. Each support 100 is secured to block 103 by a threaded stud 108 having a nut 110 on one end and a knurled knob 112 on the other end such that rotation of the knurled knob to loosen it enables this adjustment slide track 105.

Each of the elongated vertical supports 100 has a vertically elongated slot 104 therein extending longitudinally in the direction of stock advancement for coarse adjustment of the registration units relative to the print cylinder. Two positions are shown in solid lines and dotted lines respectively in FIG. 3. The registration units are locked in place on these supports 100 by a threaded fastener 115 having a turn knob 113 on one end, a lock block 131 through which the fastener extends and which abuts support 100, and having a nut 117 on the opposite side of support 100. Loosening of this fastener allows sliding of the unit on the support for coarse adjustment of each unit relative to the print station. Fine adjustment of the units is achieved by adjustment of a threaded stop bolt 134 having a turn knob 135 for each unit in a manner to be explained hereinafter.

The registration unit functions relative to the transverse slit and the two adjacent stock edges and adjacent stock areas. More specifically, the registration device functions by offsetting, out of the plane of the stock, at least one of the stock edges formed at the slit, and the adjacent stock material, for engagement of the offset edge with a registration surface. In the form of the registration apparatus shown in FIGS. 3 and 4, this offsetting is done by a pressure differential.

This pressure differential is formed across the web as the web travels adjacent the web contacting surface 120 of female offsetting element 122. This element is mounted on one side of support 100. Extending from the opposite side, i.e. backside of this element 122 is an integral shoulder 122' which projects through and is movable in slot track 104 and extends through and is movable in an elongated vertical slot 128' in a C-shaped bracket member 128 on the opposite, i.e. backside of support 100. A block 124 abuts this shoulder 122' and straddles slot 128'. A pair of bolts 130 extend through block 124 and into shoulder 122' to hold them together snugly but allow them to be moved along element 100. This movement is achieved by the stud 134 which threadably extends through a guide piece 136 that projects into slot 104, and through the upper end flange of element 128, and abuts the upper end of block 126. The opposite end of block 126 is biased by a compression spring 138 positioned between the lower end flange of element 128 and the lower end of block 126, being retained in position by fitting within a recess in the block. This compression spring biases the block 126 and also elements 124 and 122 toward the abutment stud 134. The C-shaped bracket 128 is attached to lock block 131 by screws 133. This arrangement enables fine adjustment of the registration device relative to the position of the printing apparatus by rotation of knob 135.

Formed into the face 120 of female element 122 is a recess 121. This recess is concavely curved from side to side, and has a tapered bottom surface such that one end of the recess i.e. the end away from the printing station which is the lower end as depicted in FIG. 3, tapers out to a feathered relationship relative to outer surface 120, while the other end is considerably deeper, terminating in an abrupt transverse shoulder 123 normal to surface 120 at the upper end of the recess, i.e. the end toward the printing station. The recess is preferably generally conical in configuration, becoming wider as it becomes deeper. Specifically it is shaped like a right conic section. However, shallow recesses of other configurations can be employed. Communicating with this recess is a passageway 125 which extends through element 122, element 124, element 128, and element 126 where it connects to a vacuum hose or tube 127 to a vacuum source such as a vacuum pump. Shoulder 123 is a registration surface. The vacuum applied to one face of the web causes the resulting pressure differential between the atmospheric pressure on the opposite side of the web and the reduced pressure at the recess. By applying this pressure differential across the web portion adjacent the slit, when the slit is just beyond registration shoulder 123, e.g. 1/16 inch or so, the web portion is caused to be offset out of the plane of the stock into the configurated recess to conform to its tapered concave configuration. The web is then shifted in a reverse direction until its offset edge engages shoulder 123.

Figure 3A:
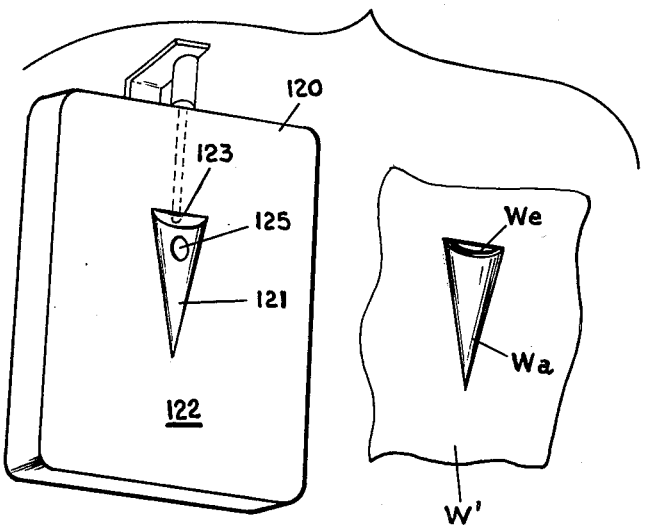
FIG. 3*a* is a fragmentary perspective view of a portion of the registration apparatus in FIG. 3, and a portion of the stock.

Referring to FIG. 3*a*, the tapered concavely configurated recess 121 is there depicted. The web portion W' is descriptively shown removed from the recess to depict the backside of the web area W*a* offset temporarily out of the plane of the web to expose a curved or arcuate web edge W*e* forming the abuttment portion of the web for engagement with the registration surface 123 at the end of the tapered recess 121.

Figure 3B:
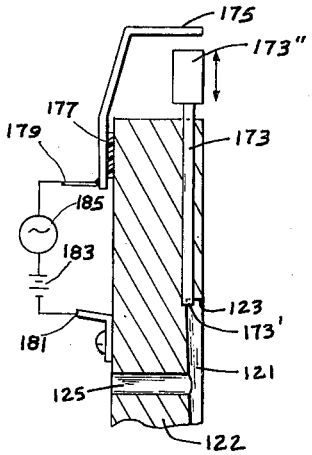
FIG. 3*b* is an enlarged sectional view of the apparatus in FIG. 3*a;*

With the material so offset into the recess, the edge of the stock will also be offset in the form of an arcuate two dimensional curve, with the maximum offset of the curve being between the two ends of the transverse slit. With the material so offset, when the web is shifted in the reverse direction a small amount, the offset edge of the stock will firmly abut the registration surface or shoulder 123 and arrest the web against further reverse motion. Since the offset edge is two dimensional, in the form of a curve or arc, even the flexible stock material offers substantial rigidity from this configuration to achieve firm engagement and allow accurate registration. The stock can be so reversed by pulling the web rearwardly over the cylinder 30 by control subassembly 18, simply by shifting the vacuum bar thereof rearwardly while holding the web back by suction. Once the edge of the offset stock at the slit firmly engages the registration surface, any slight excess shifting of the web tension control merely will cause slippage between the vacuum bar 20 and the web stock (FIG. 5) so as not to upset the accurate registration. When the stock is in accurate registration, this face is preferably indicated by a detector means shown as a signaling device in FIGS. 3, 3*a*, and 3*b*. Specifically, a shiftable switch actuator in the form of an electrically conductive metal plunger 173 slidably retained in element 122. Plunger 173, oriented in the direction of the web movement, has one end 173' positioned at shoulder 123 and projecting therethrough into recess 121 a small fraction of an inch when plunger 173 is biased as by gravity to its nonactivating condition (FIG. 3*b*). The opposite end 173'' is enlarged and normally spaced a small fraction of an inch from a metal spring switch contact 175. Contact is mounted as to element 122 and electrically insulated therefrom as by insulator mount 177. An electrical lead 179 (shown partially schematically) is connected to contact 175. A second lead 181 is connected electrically and physically to metal element 122. These leads 179 and 181 are connected to a suitable power source 183 and an indicator 185. Thus, when the stock edge W*e* is shifted in reverse against shoulder 123, plunger 173 is shifted by the stock against its bias until end 173' is flush with shoulder 123, causing end 173'' to engage contact 175 and close the electrical circuit. This will indicate to the operator that the stock is in registry. When the stock is so registered, the next registration slit is formed into the stock upstream of the stencilling station, and the stencilling operation at the stencilling station is then actuated to advance the web and stencil it. The circuit in FIG. 3*b* can also be used to -signal these operations as well as to indicate registry to the operator. The process is then repeated. During the initial setup, if the registration device is not stopping the web in the correct position, coarse adjustment of the registration mechanism can be achieved by loosening knob 113 on threaded stud 115 and nut 117 to allow the registration unit to be shifted on support 102 to any position between the two extreme positions depicted in FIG. 3. Then, with retightening of knob 113, fine adjustment can be made by rotating knob 135. At each successive stencilling station, and/or embossing station, cutoff station, or otherwise, the web can be again placed in exact registry by repeating the above steps with like apparatus.

It has been found that for stock above three mils in thickness, the stock has sufficient rigidity normally so that only one such slit need be formed. However, for stock of less thickness, it is preferable to have at least two laterally spaced slits so that at least two offset edges of the stock can simultaneously engage registration surfaces. Also, tabs can be applied at the web areas slit to reinforce the stock if desired, although this is not normally necessary.

Using the apparatus of FIGS. 1–5 therefore, the stock in the form of a web extends from a supply roll or other source past the vacuum pullback subassembly 18, past the slit forming subassembly 16, through the print station, and past the registration subassembly 14. The stock is advanced intermittently during operation. Specifically, assuming the stock is in the position depicted in FIGS. 3 and 5, and that a print stroke has just been performed on the stock, the stock next is registered in order to slit the stock upstream of the printing station in accurate relation to the slits already formed, so that this portion of the stock will be ready for registration when it moves downstream of the printing station, and in order to stencil the stock. When the slit or slits in the stock are adjacent but just past registration surface 123, vacuum is applied to recess 121. If the slit is not just past this point, then coarse adjustment can be made to shift the registration subassembly vertically on support 102 by loosening knob 113 and manually positioning it. Fine adjustment is made with knob 135. With the slit located just downstream of registration shoulder 123, and vacuum applied to recess 121, the area W*a* of the stock or web W is offset temporarily of the plane of the stock so that the edge W*e* of the web is formed into an arcuate abutment surface. Then the vacuum pullback device 18 is activated by shifting power means 26 a small amount rearwardly so that the vacuum bar 20 reverses the direction of the stock until edge W*e* abuts registration surface 123. Once registration is achieved, slitting subassembly 16 is activated by actuating cylinder 80 which pivots bar 68, to reciprocate cutting elements 60 through the web in slot 50, in cooperation with the cutting edge elements 52. These new slits are therefore a direct control distance from the slits which are at the register subassembly, the web inbetween being held in controlled tension. As soon as these slits are formed, the printing or stencilling function is activated to cause the stencil screen frame 32 to move forwardly simultaneously with rotation of the support cylinder 30, whereby a portion of the fluid in the stencil screen frame end and on the stencil in the bottom of the frame is caused to be forced through the stencil by squeegee 34 onto the web stock. The reverse movement of the stencil screen frame after this stencilling oepration will cause the flow coater 35 to spread the remaining fluid over the stencil again in conventional fashion.

It will be noted that as this web which is freshly stencilled is advanced to the registration device, registration actually occurs right at this freshly stencilled and normally wet portion of the web. In other words, the wet web portion already stencilled is used as a standard to register the portion of the web upstream of it and about to be stencilled. Yet, there is no physical engagement with the outer wet surface of the web so that the ink or other material thereon is not disturbed. The fact that this apparatus enables a portion of the web already stencilled to be used for registration of following portions is very significant relative to registration accuracy and has not been possible heretofore, as far as is known.

After the web travels through this printing station, it can be passed to like succeeding printing stations or other operational stations having like registration apparatus, for multiple color application or the like. The same slits and adjacent web edges are used at each successive station where a printing or other operation is performed on the stock. In succeeding stations of course, it will not be necessary to have further slit forming means.

The pressure differential type registration arrangement depicted in FIGS. 3 and 4, particularly located downstream of the printing station consititutes the preferred form of this invention for stencil printing of multiple colors at successive stations. For some particular types of stock, however, and some particular uses, alternative embodiments of slit registration mechanisms can be useful. One of these is depicted in FIGS. 6–8, one in FIG. 9, and one in FIGS. 10–12.

Second Embodiment

Figure 6:
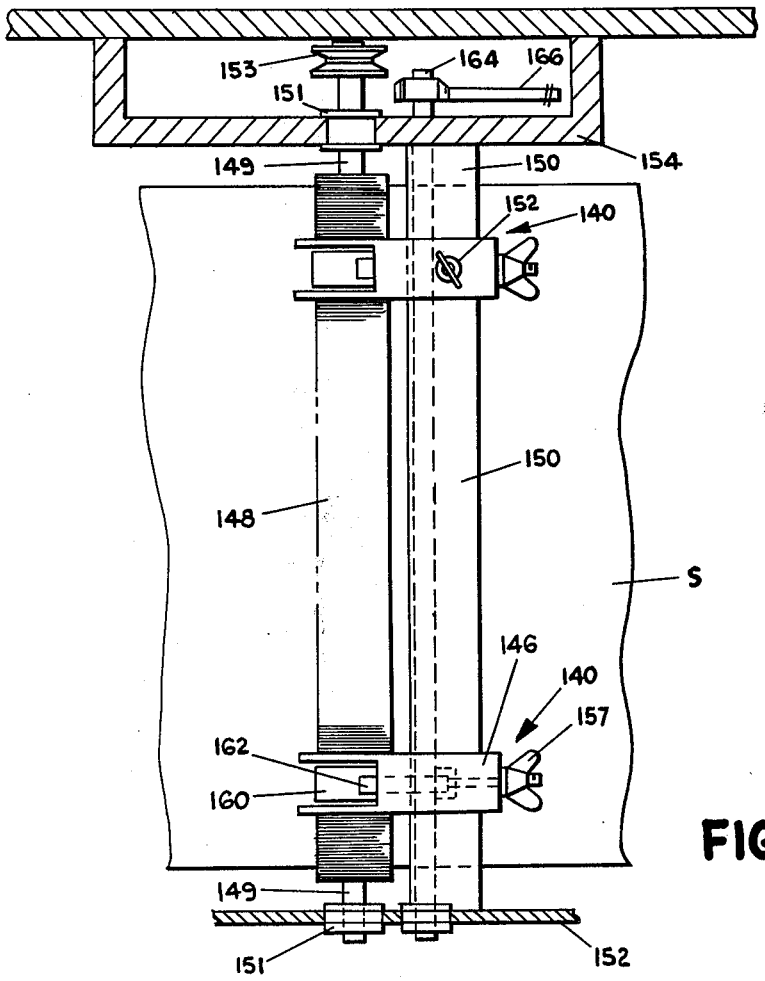
FIG. 6 is a plan view of a second embodiment of slit registry apparatus.
Figure 7:
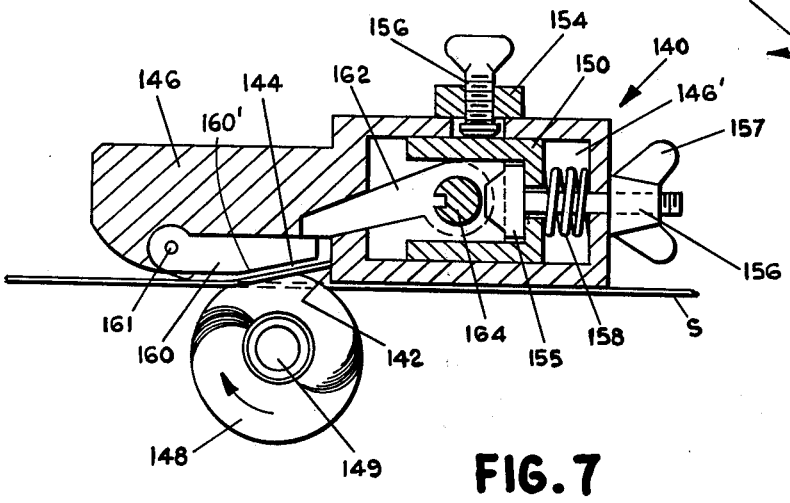
FIG. 7 is a partial elevationial view of the apparatus in FIG. 6.
Figure 8:
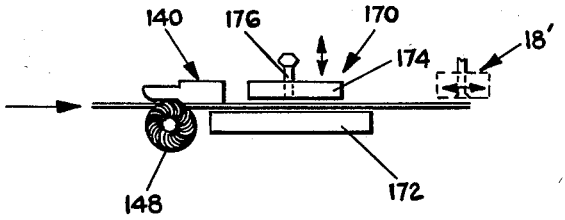
FIG. 8 is an elevational schematic view of the apparatus in FIGS. 6 and 7 in combination with flat bed stencilling apparatus.

Referring specifically to FIGS. 6–8, the offsetting means to force the web portion and adjacent edge into the recess adjacent the registration shoulder is there shown to be a flexible element in the form of an elongated cylindrical brush. This version of the registration apparatus 140 is intended to normally be mounted upstream of the stencilling station or the like, depicted schematically in FIG. 8 to be a flat bed stencilling apparatus 170. The stock S, such as sheet stock, is advanced through the registration apparatus and then into the stencilling station so that the stock can be put into registry as it is about to be stencilled. The registration shoulder 142 for the offset portion of the stock is at one end of the recess 144 formed into body 146. In this recess is a pivoted element 160 described further hereinafter, which has a surface 160' tapering from the upstream end thereof to the deeper portion of recess 144 adajcent shoulder 142 that is positioned towards the stencilling station. Surface 160' may be with a concavely curvalinear recess from side to side, becoming wider as well as deeper from the upstream end to the opposite end, resembling a conic section.

Brush 148 is mounted on a shaft 149, with its ends supported in suitable bearings 151 in plates 152 and 154. A suitable pulley 153 on the end of shaft 149 may be connected to a power drive for rotating the brush. The power driven, rotating, cylindrical brush 148 is positioned on the opposite side of the stock transfer plane from this recess, and is rotated toward shoulder 142 so that the flexible bristles of the brush will serve the dual function of advancing the stock toward the registration surface by frictional engagement therewith and also offsetting a portion of the web stock and the stock edge adjacent the slit into recess 144 until the curved offset edge engages registration shoulder 142. The stock is then in registry for next slit to be formed upstream thereof, and for the stencilling operation to then begin.

The registration position, i.e. the position of shoulder 142, can be adjusted toward or away from the stencilling station. In the apparatus as depicted, housing 146 is slidably mounted on a fixed support member 150 in a fashion to be adjusted relative thereto. More specifically, elongated support 150, extending transversely of the direction of stock advancement, is secured at its opposite ends to a pair of support plates 152 and 154 (FIG. 6), this support 150 extending through the opening 146' in housing 146. Housing 146 is secured to bar 150 as by a suitable threaded thumb-screw 152 extending through a fixed collar 154 and through an opening in housing 146 to engage bar 150 (FIG. 7). Loosening of this thumb-screw enables the housing to be adjusted along the length of the bar. Londitudinal adjustment, i.e. relative to the direction of stock advancement, is achieved by a combination of a threaded fastener 156 having a winged nut 157 on the outer end, and extending through the downstram portion of housing 146 and through bar 150 to an enlarged head 155 on the inner end, to enable the housing to be squeezed toward the bar against the bias of compression spring 158 between the housing and bar.

Because the registration shoulder 142 serves as a stop to the stock in the forward moving direction, the stock, after registration, must be released from this abrupt shoulder to allow the stock to advance. This release is achieved by a pivotal lever 160 adjacent recess 144 and adjacent the face of the stock toward which it is offset. Lever 160 is pivotally attached at pin 161 to housing 146. This lever can be depressed toward the offset stock area by a pivotal dog 162 mounted on elongated bar 164 and extending out the end of the bar for connection with crank 166 (FIG. 6). Shifting of crank 166 by suitable means will pivot dog 162, and element 160, to force the offset web area back out of the recess to enable it to advance smoothly past the registration shoulder.

The stencilling station 170 is there depicted as a flat bed press for illustrative purposes but may be a cylindrical bed or the like. This flat bed press 170 (FIG. 8) includes a flat bed support 172, a stencil screen support frame 174, squeegee 176 and the like in conventional fashion. Such an apparatus is provided with means to cause relative longitudinal motion of the transversely extending squeegee with respect to the stencil and the stock support surface. Also such conventional apparatus is provided with means to cause relative movement of the squeegee and stencil toward and away from the stock and its support surface. A typical flat bed arrangement is depicted in more detail for example in U.S. Pat. No. 2,917,997 issued Dec. 22, 1959 which is incorporated by reference herein. Since this is conventional, details of such are not further set forth herein. Further, although FIG. 6 shows two such registration devices 140, any selected number can be used in desired positions transversely of the stock S.

In operation of the apparatus in FIGS. 6—8, the stock, which may be in the form of web stock or sheet stock, is fed by any suitable advancing means to the registration apparatus, between the elongated cylindrical brush 148 and the overlying housing. As the revolving brush advances the sheet to the stencilling station, the transverse slit (or slits) is advanced to the area of recess 144. At this point, the brush temporarily offsets the stock area adjacent the slit, i.e. immediately behind the slit, into the concave recess 144, also offsetting the one stock edge at the slit into a curvalinear configuration which, upon further advancement of the stock by the brush, strikes against the registration surface 142 which is normal to the direction of stock travel. At this point, the advancement of the stock is arrested by this engagement, the revolving brush continuing to keep the stock depressed into the recess, and against shoulder 142, but not advancing the stock. With registration thus achieved, the stencil screen and squeegee are lowered to grip the stock against the support surface 172 for stencilling. Just prior to advancement of the stock again, the offset portion of the web is released from the registration surface by lowering of pivotal elements 162 and 160 to push the offset web area back out of the recess. If the stock is advanced during the operation, such as stencilling, that is to be performed, the web must be released just prior to said operation. If, however, the stock is held stationary during the operation, the web need not be released until the stock is again about to be advanced after the operation.

This second embodiment could of course be used with stencilling equipment that employs a support cylinder as shown, or for other operations on slittable, offsettable stock.

This apparatus in the second embodiment can be particularly advantageous for sheet stock, especially thin sheet stock, because registration thus does not depend upon any rearward pushing action upon the front edge of the sheet or elsewhere as would conventionally be necessary. The slits can be formed at the tail portion of the sheet such that registration exerts a basic pulling-type function to put the sheet generally in tension rather than compression. It may be desirable in some instances to shift the register surface slightly rearwardly after the initial engagement of the offset sheet edge with the registration surface 142. This would assure firm engagement of the edge to the registration surface in the event that the brush had not caused full engagement of the slit edge against the registration surface. This rearward shift momentarily of the registration mechanism could be achieved by any suitable power means such as a fluid cylinder, a mechanical device such as a cam or crank, or a solenoid, or the like.

Figure 5:
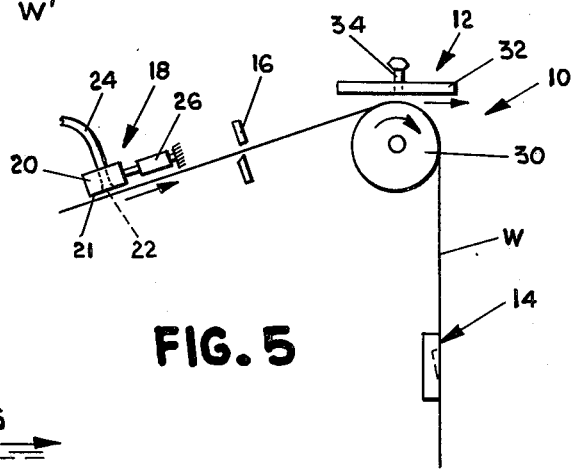
FIG. 5 is a schematic elevational view of the apparatus in FIGS. 1–4.

A tension control, stock pulling device such as a vacuum bar arrangement discussed relative to FIG.5 at 18 can be employed with this second embodiment, but it would be mounted downstream of the station 170 as at 18' (FIG. 8) and in reverse orientation so as to pull the stock toward the station and into engagement with the registration device 140. Alternatively, if the second embodiment is used on web stock, a tension control assembly as at 270 in FIG. 9 in the third embodiment can be used to pull the stock toward the stencilling station and into engagement with the registry device.

Third Embodiment

Figure 9:
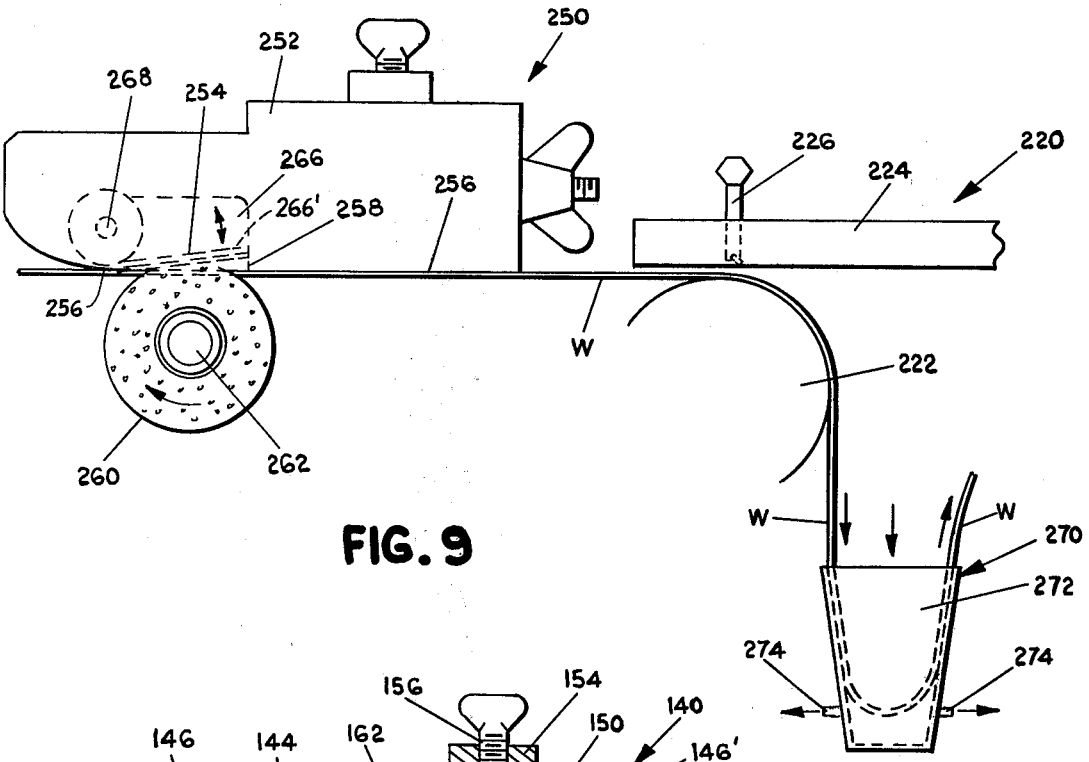
FIG. 9 is an elevational view of a third embodiment slit registry apparatus in combination with web stencilling equipment.

Referring now specifically to FIG. 9, a further embodiment is there shown in combination with a stencilling apparatus, the registration mechanism being upstream of the stencilling apparatus, and, for controlled tension of the web between the registration means and the stencilling station, a vacuum or pressure differential tension control subassembly 270 downstream of the stencilling station.

More specifically, the complete combination in FIG. 9 includes stencilling apparatus 220, registration apparatus 250, upstream of stencilling apparatus 220, and tension control apparatus 270 downstream of the stencilling apparatus. The stencilling apparatus may be varied in form, a typical type arrangement being that set forth in FIG. 8*a* of U.S. Pat. No. 3,783,059. Such apparatus is incorporated by reference herein.

The tension control assembly 270 includes a housing 272 forming an open top chamber into which the web stock W enters along one side and exits along the other, there being a controlled pressure differential applied to the loop of web within the chamber. This pressure differential is maintained by applying a dynamic suction or vacuum to lower portions of the chamber to suitable vacuum connections 274 and/or applying forced air flow down into the top of the chamber. The detailed disclosure of such a tension control means is set forth in copending U.S. patent application Ser. No. 515,639, filed Oct. 17, 1974, entitled VERTICAL DRYER, now abandoned and is incorporated by reference herein.

The registration apparatus 250, as in the second embodiment above described, is positioned upstream of the stencilling station. It includes a housing 252 containing a recess 254, the bottom surface 266' of which slopes from a merging relationship with the web engaging undersurface 256 of housing 252 to an abrupt registration shoulder 258 in recess 254, such shoulder extending generally normal to the direction of travel of the web stock W. Surface 266' may possess a generally conically shaped concavity. The offsetting means on the lower side of the web, to cooperate with the recess 254 on the upper side of the web, constitutes a foam rubber or other resilient polymeric material such as polyurethane, polyvinyl chloride, or other flexible resilient polymer in the form of an elongated cylinder 260 rotated on a driver shaft 262. This depresses a portion of the web stock immediately adjacent the registration slit, and also the edge of the stock adjacent the slit to abut against the registration surface 258 on the downstream side of recess 254, i.e. toward the stencilling station, while also advancing the stock into such registration. In this particular embodiment, the web stock is advanced during the stencilling operation, with rotation of the support cylinder 222 and advancement of the stencil screen frame 224 while the squeegee 226 remains stationary adjacent the crown of the cylinder. Thus, after registration and during the stencilling operation, the offset portion of the web must be released from recess 254 after the squeegee lowers and the stencil lowers to secure the web stock to the cylinder, but before the cylinder and screen frame begin advancing with the web. This release of the web portion is achieved by depressing it with a pivotal lever 266 mounted on a powered pivot shaft 268. Any suitable motor means (not shown) can be used to pivot shaft 268.

In operation of this third embodiment, the web W is controllably slit, is fed through registration apparatus 250, stencilling station 220, and tension control apparatus 270. Assuming that a print stroke has just been completed on a portion of the web, and that the pressure of the squeegee and stencil screen has been released from the web stock on the cylinder, the rotation of the resilient roll 260 tends to advance the web toward the cylinder a small amount, with the tension control means 270 taking up any slack which is thus provided. This occurs until a transverse registration slit moves into the area adjacent recess 254, at which time the resilient roll 260 not only advances the web but also depresses a portion of the web immediately adjacent the slit, and the edge of the web thereat, into the recess until the edge of the web engages the registration surface 258. At this point, the web stops while the roll 260 continues to rotate to maintain the portion of the web in this registration condition. The registered web can then again be slit upstream of the registration zone by a slitter such as that in the first embodiment. Also, the squeegee and stencil are lowered to secure the web against the cylinder. Lever 266 is depressed to release the registered web portion, and cylinder 220 is rotated a controlled amount along with advancement of stencil screen frame 224 to cause the squeegee to force a controlled amount of fluid through the stencil pattern onto the web stock as the web stock is advanced. The advancing web stock is constantly controlled by the tension control unit 270 as the web is also pulled from the tension control by means at the next station (not shown) such as a drying station, the next printing station, an embossing station, a trimming station, a rewind station, or the like. In addition, the constant air movement across the wet surface of the web traveling through tension control device 270 serves a drying function.

Fourth Embodiment

Figure 10:
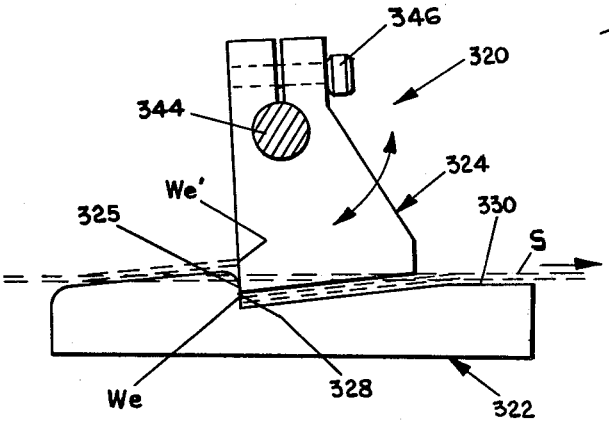
FIG. 10 is an elevational view of a fourth embodiment of slit registry apparatus.
Figure 12:
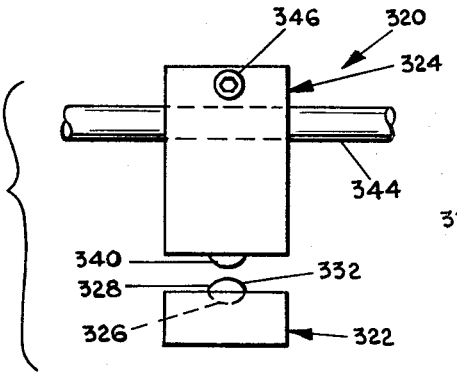
FIG. 12 is an exploded end elevational view of the apparatus in FIGS. 10 and 11.
Figure 11:
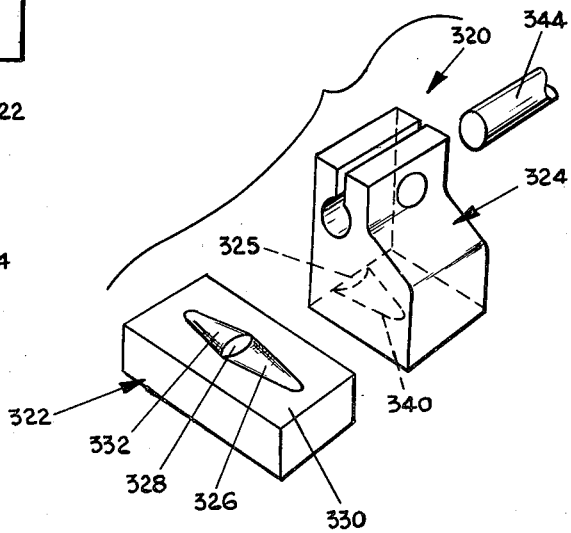
FIG. 11 is an exploded perspective view of the apparatus in FIG. 10.

Referring now specifically to FIGS. 10–12, the embodiment there depicted constitutes a registration subassembly wherein the offsetting means is mechanical, i.e. physical, by reason of the interengagement of cooperative elements which have cooperatively interfitting concave and convex portions. In this particular embodiment, both edges of the material astraddle of the slit, and both areas adjacent these edges, are offset, in opposite directions, out of the plane of the stock.

The registration subassembly 320 there depicted includes female member 322 cooperative with male member 324 between which the stock such as sheet or web stock S is advanced, and temporarily halted for registration. Member 322 includes a recess 326 which is tapered from an abrupt deeper portion at a flat registration surface 328 generally normal to the stock advancement, the tapered surface 326 gradually merging with the upper surface of element 322 toward the direction of advancement of the stock. The cross section of this recess is concave so that the side edges also merge or feather into the upper surface 330 of the element. The overall configuration is basically conical. Upstream of this surface 328, relative to the direction of stock advancement, element 322 has a convex protrusion 332 which also tapers from its most protruding portion adjacent surface 328 to a gradually decreasing portion upstream of the stock relative to the direction of advancement. This protrusion is convexly curved from side to side. I.e., the configuration is also basically conical.

Element 324 is movably mounted to shift into and out of engagement with element 322. More specifically, the bottom portion of element 324 includes a convex tapered portion which is configured to be complementary to recess 326, the protruding convex portion 340 tapering from a maximum protruding area adjacent the upstream end thereof, i.e. adjacent surface 328 of element 322, and gradually tapering downwardly toward the downstream end of element 324. Protrusion 340 is also convexly curved from side to side, having a generally conical configuration. The movement of element 324 relative to element 322 is preferably in two directions simultaneously, i.e. transversely toward the plane of the stock, and longitudinally rearwardly relative to the direction of the stock advancement. This compound movement may be achieved as by mounting element 324 on a pivot shaft 344 extending through a bifurcated portion on the upper end of element 324, and being retained on this shaft to rotate therewith as by a suitable lock screw 346. By power rotating shaft 344 in a clockwise direction, as viewed in FIG. 10 therefore, element 324 can be brought downwardly and rearwardly into operative engagement with element 322, and with the slit stock therebetween.

Thus, by advancing the transverse slit in the stock slightly past surface 328, and then bringing element 324 downwardly and rearwardly, the convex protrusion 340 forces the one edge of the stock and adjacent stock area downstream of the slit into an offset configuration, into the conical configuration between protrusion 340 and recess 326, the rear edge surface 325 of element 324 engaging the edge W*e'* and reversing the direction of the stock slightly until surface 325 strikes surface 328 and stock edge W*e* also strikes surface 328. As can be readily seen, this also offsets edge W*e'* and the adjacent stock area upstream of edge W*e'* upwardly out of the plane of the stock while edge W*e* is forced downwardly out of the plane of the stock. This arrangement securely locks the stock into an accurate registry position for the next operation such as stencilling. Further, this registration can be performed on the tail portion of sheet stock, or on web stock, as necessary. Once the stock is so registered, if a stencilling operation is to be performed thereon, the stencil screen frame is lowered into engagement with the underlying support surface such as a cylinder or a flat bed of the type explained relative to previous embodiments, at which time the registration apparatus can be released from the stock to enable it to be advanced if necessary. This release occurs simply by reversing the movement of element 324, i.e. in a counterclockwise direction as depicted in FIG. 10.

The transverse registry slits can be formed into the stock with the slitter set forth in the first embodiment.

During the registration step just described, when physical engagement occurs between element 324 and element 322, i.e. through the opening formed by the slit and the two offset portions of the stock astraddle thereof, this physical engagement can be employed to trigger subsequent operations such as the initiation of the stencilling operation and the subsequent release of the registration apparatus. For example, if the surfaces 325 and 328 are electrically conductive, the contact therebetween can be employed to close an electrical circuit or otherwise trigger subsequently operating mechanisms.

Each of the specific embodiments set forth herein can conceivably be employed in special circumstances where the other embodiments would not be operable or as desirable. There are distinct differences between them which make each unique, even though all of them have certain features in common, i.e. the offsetting means cooperable with the slit stock, and the registry means cooperable with the offset edge of the slit stock.

It is also apparent that the particular registration devices may be used in combination with various equipment in addition to stencilling means or different types of stencilling means than illustrated. Specific details of any particular embodiment may be modified to suit special situations. Hence, the invention illustrated by these embodiments is intended to be limited only the scope of the claims attached hereto rather than to the details of these illustrative embodiments.

The embodiments of the invention in which an exclusive property or privilege is claimed are defined as follows:

1. Slit registry apparatus for position registration of flexible, generally planar stock on which an operation is to be performed comprising:

slit forming means operable on the stock for creating a slit transverse to the direction of stock advance and two adjacent stock edges;

stock offsetting means for offsetting the stock adjacent the slit and offsetting the formed edges out of the plane of the stock, and stock shifting means for shifting the stock longitudinally, normal to said transverse slit;

said stock offsetting and shifting means comprising a pair of stock straddling members, on having at least one tapered recess with a registration surface at one end, and the other member having at least one tapered projection interfittable in said recess, said members being shiftable transversely and longitudinally of the stock, toward each other, and into interengagement, for causing stock offsetting and stock shifting for registration engagement of said registration surface and the offset stock edge.

2. In a stencilling assembly, slit registry apparatus for position registration of flexible, generally planar stock on which a stencilling operation is to be performed, said stencilling assembly including a stencilling station spaced a predetermined amount from said slit registry apparatus, and stock advancing means for advancing stock through said stencilling station and said slit registry apparatus, said slit registry apparatus comprising:

slit forming means operable on the stock for creating a slit transverse to the direction of stock advance and two adjacent stock edges;

stock offsetting means for offsetting the stock adjacent the slit and thereby offsetting at least one of the formed edges, out of the plane of the stock;

registry means including edge engaging means for engaging the offset edge for registry of said stock with respect to said stencilling station when the stock is shifted in reverse;

stock reversing means for pulling stock a predetermined amount in reverse, relative to said advancing, to cause said offset stock edge to engage said edge engaging means for registry of said stock with respect to said stencilling station; said offsetting means comprising means for forming a gaseous pressure differential across the stock adjacent the slit.

3. In a stencilling assembly, slit registry apparatus for position registration of flexible, generally planar stock on which a stencilling operation is to be performed, said stencilling assembly including a stencilling station spaced a predetermined amount from said slit registry apparatus, and stock advancing means for advancing stock through said stencilling station and said slit registry apparatus, said slit registry apparatus comprising:

slit forming means operable on the stock for creating a slit transverse to the direction of stock advance and two adjacent stock edges;

stock offsetting means for offsetting the stock adjacent the slit and thereby offsetting at least one of the formed edges, out of the plane of the stock;

registry means including edge engaging means for engaging the offset edge for registry of said stock with respect to said stencilling station when the stock is shifted in reverse;

stock reversing means for pulling stock a predetermined amount in reverse, relative to said advancing, to cause said offset stock edge to engage said edge engaging means for registry of said stock with respect to said stencilling station; said offsetting means including a configurated recess and suction orifices in said configurated recess.

4. Slit registry apparatus for position registration of flexible, generally planar stock on which an operation such as stencilling is to be performed comprising:

slit forming means operable on the stock for creating a slit transverse to the direction of stock advance and two adjacent stock edges;

stock offsetting means for offsetting the stock adjacent the slit and thereby offsetting at least one of the formed edges out of the plane of the stock and, stock shifting means for shifting the stock normal to said transverse slit;

and registry means including edge engaging means in a fixed spaced relation relative to said slit forming means, for engaging the offset edge for registry of the stock as the stock is shifted; said stock offsetting means comprises a recess and cooperative stock depressing means for offsetting the stock, and said stock shifting means comprises stock pulling means for shifting the stock; said stock depressing means comprises means for forming a gaseous pressure differential across the stock adjacent the slit.

5. Slit registry apparatus for position registration of flexible, generally planar stock on which an operation such as stencilling is to be performed comprising:

slit forming means operable on the stock for creating a slit transverse to the direction of stock advance and two adjacent stock edges;

stock offsetting means for offsetting the stock adjacent the slit and thereby offsetting at least one of the formed edges out of the plane of the stock and, stock shifting means for shifting the stock normal to said transverse slit;

and registry means including edge engaging means in a fixed spaced relation relative to said slit forming means, for engaging the offset edge for registry of the stock as the stock is shifted; said stock offsetting means comprising a rotational resilient means for resiliently offsetting the stock.

6. The apparatus in claim 5 wherein said rotational resilient means comprises a rotational generally cylindrical brush.

7. The apparatus in claim 5 wherein said rotational resilient means comprises a rotational generally cylindrical polymeric member.

8. A combination slit registry and stencilling apparatus enabling resgistry of a portion of web stock to be stencilled by action on a portion of web stock just previously stencilled, comprising:

web stock advancing means for advancing web stock through said apparatus;

a stencilling station with stencil coating apparatus thereat;

slit forming means upstream of said stencilling station, relative to the web stock advancement direction for creating a slit transverse to the direction of stock advance and two adjacent edges;

offsetting means downstream of said stencilling station for offsetting the web stock adjacent the slit and at least one of the formed web edges, out of the plane of the web stock;

web reversing pulling means for shifting the web stock in reverse; and edge engaging means downstream of said stencilling station, for engaging the offset web edge of a previously stencilled web portion with said reverse shifting of the web stock, for registry of the web stock portion about to be stencilled; said offsetting means comprising a configurated recess and cooperative, gaseous pressure differential, web depressing means for depressing the web stock into said configurated recess.

* * * * *